US007641601B2

(12) United States Patent
Jaet

(10) Patent No.: US 7,641,601 B2
(45) Date of Patent: Jan. 5, 2010

(54) MARTIAL ART TRAINING TOOL

(76) Inventor: George Michael Jaet, 2334 Orleans La., Seabrook, TX (US) 77586

( * ) Notice: Subject to any disclaimer, the term of this patent is extended or adjusted under 35 U.S.C. 154(b) by 50 days.

(21) Appl. No.: 11/238,538

(22) Filed: Sep. 29, 2005

(65) Prior Publication Data

US 2007/0072747 A1 Mar. 29, 2007

(51) Int. Cl.
*A63B 21/00* (2006.01)

(52) U.S. Cl. ..... 482/87; 482/83

(58) Field of Classification Search ..... 482/83–90; 446/298; 473/441; D21/787
See application file for complete search history.

(56) References Cited

U.S. PATENT DOCUMENTS

| | | | | | |
|---|---|---|---|---|---|
| 892,388 | A * | 7/1908 | Aumann | 482/87 |
| 2,307,905 | A * | 1/1943 | Ament | 119/708 |
| 2,435,864 | A * | 2/1948 | Adams | 482/90 |
| 2,496,795 | A * | 2/1950 | Johnson | 473/575 |
| 3,186,711 | A * | 6/1965 | Morrow | 472/118 |
| 3,216,723 | A * | 11/1965 | Galezniak | 473/429 |
| 3,288,413 | A * | 11/1966 | Gregory | 248/158 |
| 3,521,885 | A * | 7/1970 | Robinson | 473/575 |
| 3,785,643 | A * | 1/1974 | Rich | 482/86 |
| 3,790,171 | A * | 2/1974 | Anderson | 473/575 |
| 4,071,241 | A * | 1/1978 | Cortes Garcia | 473/424 |
| 4,130,276 | A * | 12/1978 | Tricarico | 482/88 |
| 4,350,338 | A * | 9/1982 | May | 473/423 |
| 5,389,057 | A * | 2/1995 | Zagata, Jr. | 482/83 |
| 5,516,116 | A * | 5/1996 | Castro | 473/429 |
| 6,024,657 | A * | 2/2000 | Bettencourt, Jr. | 473/427 |
| 6,328,665 | B1 * | 12/2001 | Gormley | 473/423 |
| 6,837,808 | B1 * | 1/2005 | Hatch | 473/424 |
| 7,115,052 | B2 * | 10/2006 | Wardle et al. | 473/459 |

* cited by examiner

*Primary Examiner*—Jerome Donnelly
(74) *Attorney, Agent, or Firm*—Delphine James

(57) ABSTRACT

The present invention is a martial arts training device. The present invention comprises a post member supported within a cylindrical shape base member that is firmly implanted below ground level. The post member extends vertically upward from the base member to a predetermined height above ground level. A ball target member is releasably connected to a swivel joint connector. A rope is used to releasably tether the swivel joint connector to a cap firmly affixed to the top end of the post member. The loop design of the rope also reduces long term fraying. When hitting and kicking the ball target member, the swivel joint connector allows free rotation of the ball target member thereby preventing rope encumberment. The increased mass and free spinning nature of the swivel joint connector increases inertia, reduces sporadic behavior, and increases stability in the ball target member.

16 Claims, 3 Drawing Sheets

MARTIAL ART TRAINING TOOL

BACKGROUND

The present invention relates to martial arts training devices. More particularly, the present invention relates to a device for training a martial artist to punch or kick.

Several inventions for practicing martial arts have been developed. For example, U.S. Pat. No. 6,736,764 disclose a device for training a martial artist to kick. The device includes a cylindrical body attached to an elongated pole supported by a T-shaped base member. However, the present invention has specific novel features that are not disclosed in the prior art.

SUMMARY OF THE INVENTION

One objective of the present invention is to provide a martial arts training tool that is simple to use. Another objective of the present invention is to provide a tool that enhances muscle growth and strength through repetitive use. The present invention comprises a post member supported within a cylindrical shape base member that is firmly implanted below ground level. The post member extends vertically upward from the base member to a predetermined height above ground level. A rope member of a single loop design for quick attachment and detachment is used to tether to the top end of the post member. The opposite end of the rope member attaches to a swivel joint connector connected to a ball target member. The loop design of the rope also reduces long term fraying. When hitting and kicking the ball target member, the swivel joint connector allows free rotation of the ball target member thereby preventing rope encumberment. The increased mass and free spinning nature of the swivel joint connector increases inertia, reduces sporadic behavior, and increases stability in the ball target member.

In an alternative embodiment, the post member is supported within a circular tubular member firmly mounted upon a flat planar base member.

The novel features which are considered characteristic of the present invention are set forth in the appended claims. The construction and method of operation of the present invention can be better understood from the following description of the specific embodiments when read in conjunction with the accompanying drawings.

DETAILED DESCRIPTION

Figure 1A:
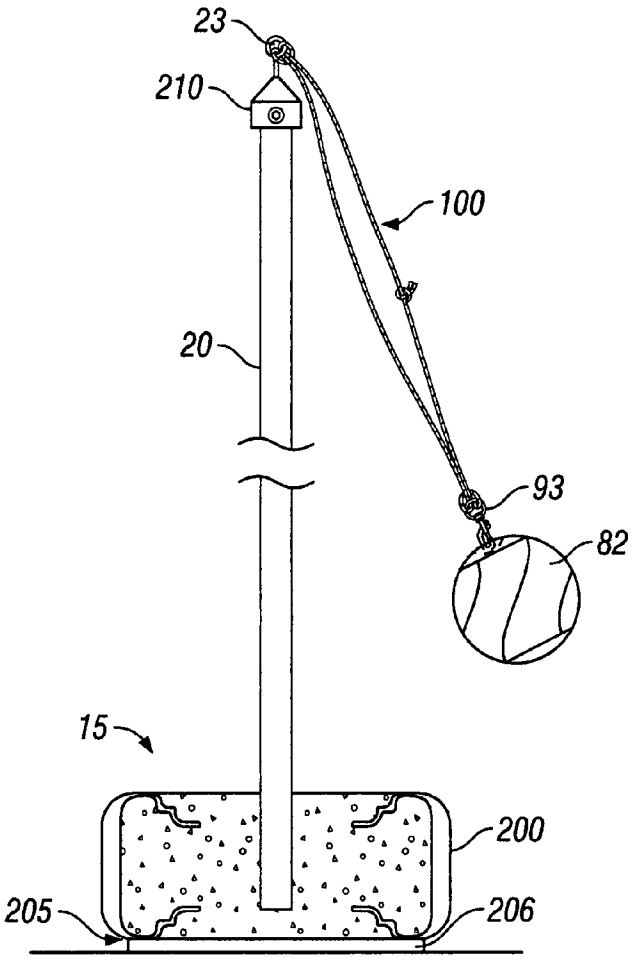
FIG. 1A is an alternative embodiment of the present invention.
Figure 1:
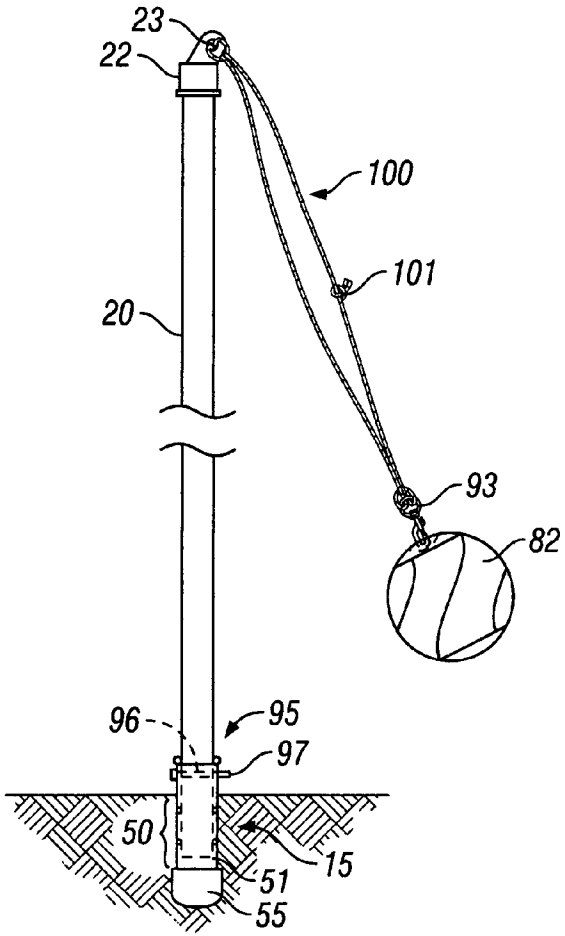
FIG. 1 is a perspective view of the present invention.

Referring to FIG. 1, there is shown, a perspective view of the present invention a martial arts training device (10). Training device (10) further comprises base member (15) for supporting an elongated post member (20) in a secure upright manner. Swivel connector member (30) connects ball target member (35). Rope (100) interconnects ball target member (35) to the top end (26) of post member (20). FIG. 1A is an alternative embodiment of training device (10).

Figure 2:
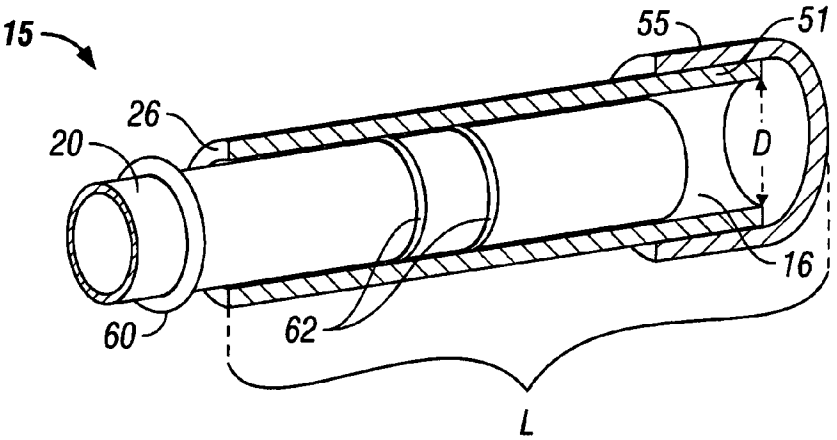
FIG. 2 is an enlarged top view of the connection between the post and the base member.

Referring to FIG. 2, there is shown an enlarged view of base member (15). Base member (15) further comprises a hollow cylindrical pipe member (16) having an opened top (26) and an opened bottom (51). As depicted, cap member (55) secures open bottom (51) to prevent debris from entering base member (15) while lower most section (50) of base member (15) is firmly implanted and secured below grown level. A second cap member like cap member (55) can be utilized to secure the opened top (26) of base member (15) when not in use thereby preventing debris from entering base member (15).

Referring to FIG. 1, as shown base member (15) is firmly implanted below ground level. In the preferred embodiment, base member (15) is secured below ground level using a strong adhesive material such as cement or another suitable material. To firmly set base member (15) below ground level, first a hole is dug below ground level and base member (15) is inserted into the hole. To further secure base member (15) liquid cement can be poured into the hole and base member (15) is set below ground level within the cement. When the cement hardens, base member (15) is securely implanted below ground level. Semi-permanent rocks or sand are alternative options to liquid cement.

As shown in FIG. 2, base member (15) has a predetermined length designated as L and a predetermined internal diameter designated as D sufficient to support post member (20). In the preferred embodiment, base member (15) is made of conventional PVC pipe having an L length of approximately 2½ feet.

Post member (20) is a long cylindrical pipe member made of a sturdy durable metal material such as steel fence pipe. As shown in FIG. 1, the lower most section of post member (20) extends vertically downward internally within base member (15) from top end (26) into cap member (55). As depicted in FIG. 2, from top end (26) of base member (15) post member (20) extends vertically upward into first cap member (22). Formed on one side of cap member (22) is an opened circular loop member (23).

In the preferred embodiment, post member (20) is approximately 10½ feet in length. When the lower most section of post member (20) is inserted into base member (15), post member (20) extends linearly upward approximately 8 feet in length. However, the length of base member (15) and post member (20) are not limited to the above stated lengths. Additionally, post member (20) can be adapted to telescope to various lengths. In even more specific embodiments, a locking mechanism (95) can be used to secure post member (20) within base member (15) thereby preventing the rotation of post member (20) within base member (15). Locking mechanism (95) further comprises an opening (96) located at a predetermined location on the outer surface of base member (15). The opening (96) extends through base member (15) and post member (20) and adapted to receive a pin (97) therethrough preventing the rotation of post member (20) within in base member (15).

As shown in FIG. 2, base member (15) has a slightly larger diameter than post member 20 to support the insertion of post member 20 into base member 15. A first sealing member 60 encircles post member 20 near the top end 26 of base member 15. To further seal post member 20 within base member 15, a second sealing member situated below the first sealing member 62. Sealing members 62 and 60 offset the gap between the base member 15 and post member 20, thereby preventing debris from entering into base member 15. Additionally, sealing members 62 and 61 absorb the friction as post member 20 rotates within base member 15. Both first sealing member 60 and second sealing member 62 can be conventional O-rings.

Post member (20) with attached cap member (22) is the preferred method of suspending target member (82) above ground level. However, target member (82) can be suspending above ground level at a predetermined level by other suitable means such as affixing one end of the rope member (100) to the end of the wall.

Figure 3:
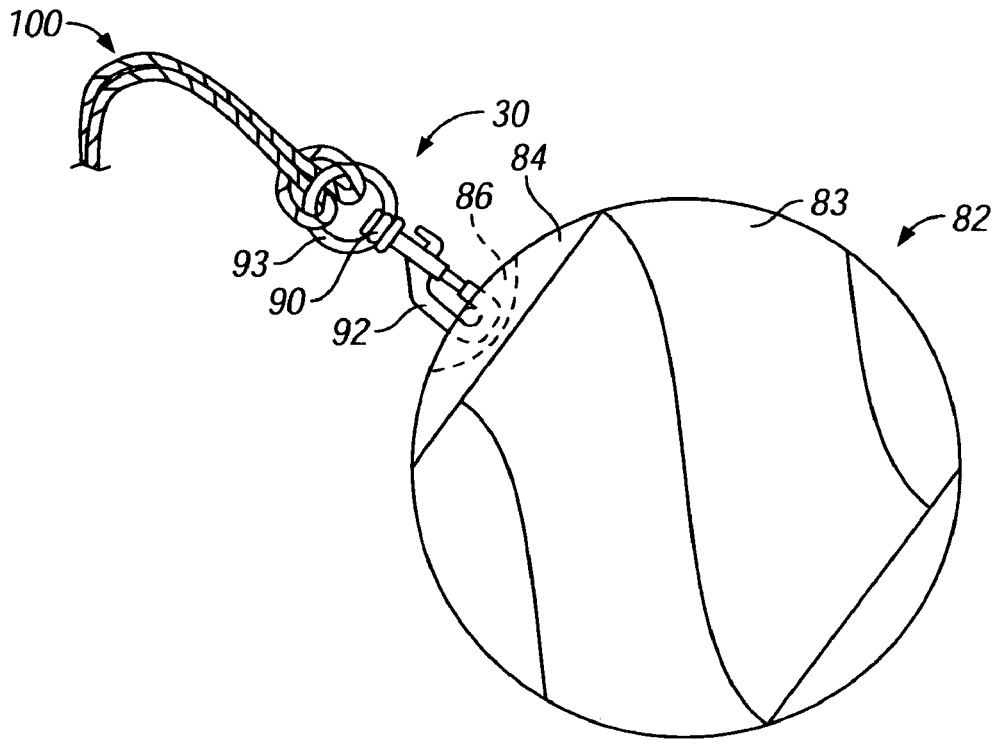
FIG. 3 is an enlarged side view of the connection between the ball and the swivel joint.

Referring to FIG. 3, there is shown an enlarged view of target member (82). Preferably, target member (82) has a spherical shape encompassed by a semi-hard protective covering (83). In some embodiments, target member (82) can further comprise an inlet fill port for injecting into target member (82) fill material such as air, sand, water, or another suitable fill material. Fill material provides additional weight to target member (82) during martial arts practice. Target ball member (82) can be the size and shape of a conventional tether ball.

Strategically mounted to target ball member 82 is small plate member 84. Formed upon plate member 84 further comprises a raised semi-circular loop member 86. Plate member 84 and loop member 86 can be made of strong metal or plastic material or another suitable material. Additionally plate member 84 is preferably mounted underneath covering 83 with loop member 86 exposed. In an alternative configuration plate member 84 can be mounted above covering 83.

Figure 3A:
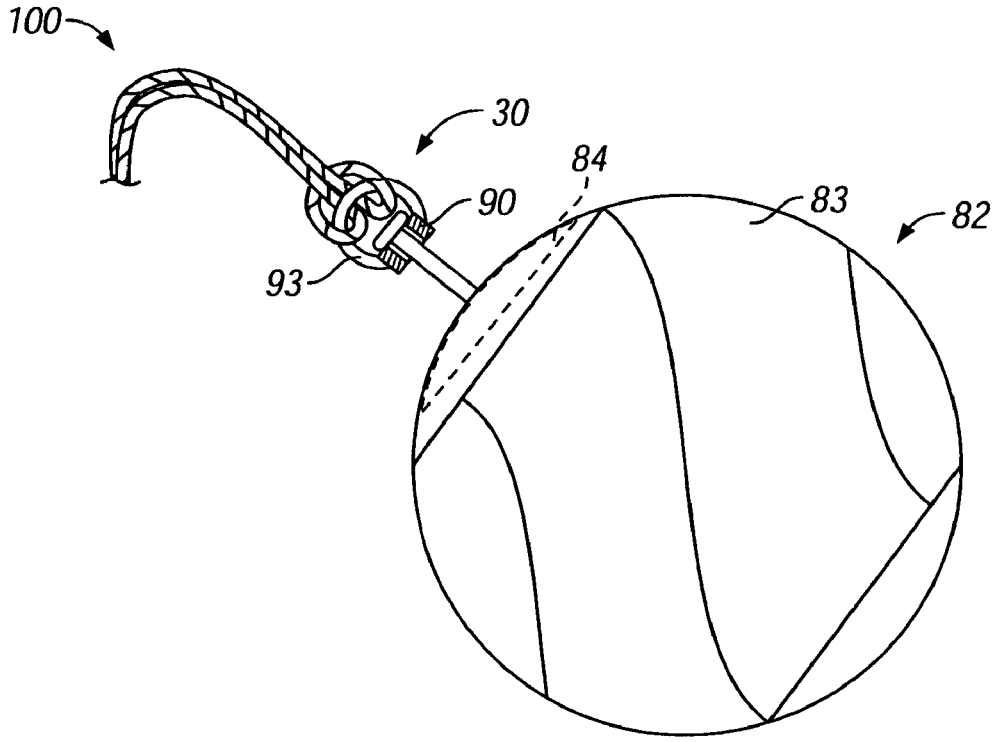
FIG. 3A is an enlarged side view of an alternative joint swivel to ball connection.

Depicted in FIG. 3, is an enlarged view of swivel connector member 30. In the preferred embodiment, swivel connector member 30 further comprises swivel joint 90 disposed between a first coupler 92 and a second coupler 93. Swivel joint 90 rotates 360 degrees. First coupler 92 has a releasable catch mechanism for attaching to loop member 86 connected to target member 82. Second coupler 93 is an opened circular loop. As shown in FIG. 3A, in some embodiments swivel connector member 30 can be permanently affixed to the target member 82 at one end. Connected to the opposing end of connector member 30 is second coupler 93 which is swivelly connected to swivel joint 90.

In an even more specific embodiment, a covering can be specifically formed for each component of swivel joint member (30). A covering can adapted for first coupler 92, second coupler 93 and swivel joint 90. The covering is created such that the operation of swivel joint member 30 is not effected.

Figure 4:
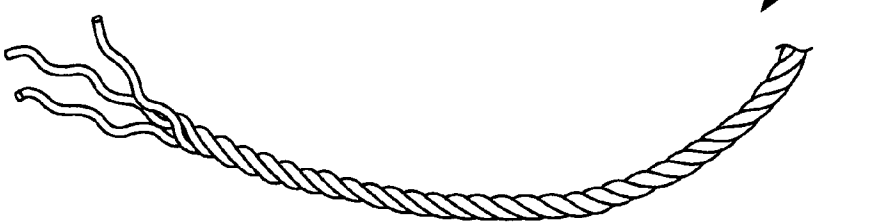
FIG. 4 is an enlarged view of the rope used to connect the ball to the swivel join.

Depicted in FIG. 4, is an enlarged view of tri-braided rope 100. Rope 100 can be made of one strand or multiple strands. As shown in FIG. 1, loop member 23 of first cap member 22 is tethered to second coupler 93 of connector member 30 using rope 100. In the preferred embodiment, since the force of hitting and kicking of target member 82 provides serious wear and tear on a single strand of rope, rope 100 is tri-braided and formed into a single complete loop for quick attachment and detachment which re-enforces rope 100 and reduces long term fraying. Rope 100 is preferably made of very strong material such as nylon. In use, each end of the tri-braided rope is secured with a knot. Then, rope 100 is inserted and pulled through second coupler 93. Rope 100 is also inserted and pulled through loop member 23 of cap member 22 to form a loop. Each opposing end of rope 100 is secured together via a square knot (101) or another suitable tying means forming a continuous loop. Varying the length of rope 100 provides different heights for practicing kicking and boxing. The shorter the length of rope 100 the faster the ball moves.

Referring to FIG. 1A there is shown an alternative embodiment of the present invention. In this configuration, there is shown an alternative embodiment for base member 15.

In this alternative configuration, base member 15 further comprises a continuous circular tubular member 200 mounted upon a flat planar support member 205. The inner circumference of circular tubular member 200 is cutout forming an internal cavity inside tubular member 20 for receiving adhesive material. The inner area of circular tubular member (200) and the internal cavity of tubular member 200 are both filled with a strong adhesive material which hardens into a strong durable weighted support material. In the preferred embodiment, the adhesive material is cement. The lower most portion of post member 20 is centrally place within circular tubular member 200 thereby affixing post member 20 an upright position.

Post member 20 is a long cylindrical pipe member made of a sturdy durable metal material such as steel fence pipe cut to a preferably length of approximately 8 feet. After being centrally placed within tubular member 200, post member 20 extends vertically upward to a desired height into conical shape cap member 210. However, the length of post member 20 is not limited to the length stated above. Conical shape cap member 210 is securely mounted onto the top end of post member 20. Formed on top of conical cap member (210) is an opened circular loop member (23). Conical cap member 210 is preferably made of a strong metal such as steel.

As shown in FIG. 1, loop member 23 of conical cap member 210 is releasably tethered to second coupler 93 of connector member 30 using rope 100. In the preferred embodiment, since the force of hitting and kicking of target member 82 provides serious wear and tear on a single strand of rope, rope 100 is tri-braided and formed into a single complete loop for quick attachment and detachment which re-enforces rope 100 and reduces long term fraying. Rope 100 is preferably made of very strong material such as nylon. In use, each end of the tri-braided rope is secured with a knot. Then, rope 100 is inserted and pulled through second coupler 93. Rope 100 is also inserted and pulled through loop member 23 of conical cap member 210 to form a loop. Each opposing end of rope 100 is secured together via a square knot or another suitable tying means. Varying the length of rope 100 provides different heights for practicing kicking and boxing. The shorter the length of rope 100 the faster the ball moves. In an alternative embodiment post member 20 with mounted conical cap member 210 can be supported by base member 15 illustrated in FIG. 1.

Figure 1B:
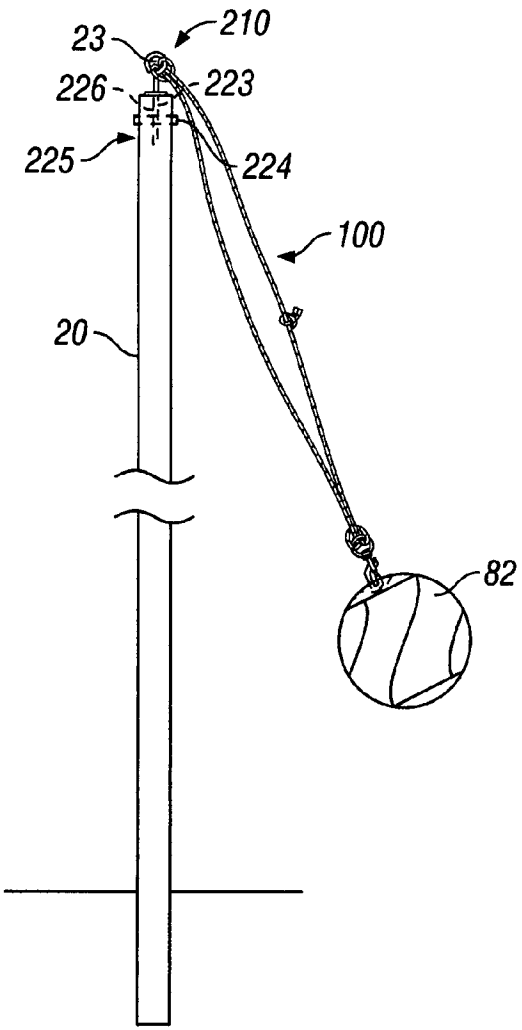
FIG. 1B is an alternative embodiment of the present invention illustrating a post member disposed below ground level.

Referring to FIG. 1B, there is shown an alternative embodiment for the present invention. In this embodiment post member 20 is a long cylindrical shaft member made of a sturdy durable wood material cut to a preferably length of approximately 10 feet. After being centrally placed within tubular member 200, post member 20 extends vertically upward to a desired height. However, the length of post member 20 is not limited to the length stated above. Coupler member 210 is securely mounted onto the top end of post member 20. Formed upon the top of coupler member (210) is an opened circular loop member (23). At the opposing end of coupler member 210 is a fastener mechanism. First Bore 225 horizontally extends through the near the top end of post member 23. Second Bore (226) vertically extends from the top end of post member 23 into first bore 225 in a perpendicular relation. First bore 1 225 is adapted to receive bolt member 224 which is adapted to securely engage with fastener mechanism 223. Coupler member 210 is preferably made of a strong metal such as steel. In an alternative embodiment post member 20 with mounted coupler member 210 can be supported by base member 15 illustrated in FIG. 1 or base member 200 illustrated in FIG. 1A.

As shown in FIG. 1, loop member 23 of conical cap member 210 is releasably tethered to second coupler 93 of connector member 90 using rope 100. In the preferred embodiment, since the force of hitting and kicking of target member 82 provides serious wear and tear on a single strand of rope, rope 100 is tri-braided and formed into a single complete loop for quick attachment and detachment which re-enforces rope 100 and reduces long term fraying. Rope 100 is preferably made of very strong material such as nylon. In use, each end of the tri-braided rope is secured with a knot. Then, rope 100 is inserted and pulled through second coupler 93. Rope 100 is also inserted and pulled through loop member 23 of conical cap member 210 to form a loop. Each opposing end of rope 100 is secured together via a square knot or another suitable tying means. Varying the length of rope 100 provides different heights for practicing kicking and boxing. The shorter the length of rope 100 the faster the ball moves.

Referring to FIGS. 1, 1A and 1B, in use target member 82 extends outward freely from post member 20 attached to rope 100. As the user kicks or hits target member 82, swivel joint rotates 360 degrees allowing target member 82 to spin freely while preventing rope 100 from twisting around post member 20. Additionally, connector member 30 provides increased inertia to resist punches and slow the ball down. The added weight of the swivel joint 20 increases the centripetal force of target member 82 wherein the sporadic behavior of target member 82 is decreased and target member 82 moves substantially on a uniform trajectory path.

What is claimed is:

1. A martial arts training device comprising: a suspension means for suspending a target member at a predetermined level above ground level; a loop rope member being defined by a first end and an opposing second end; a first coupling member releasably interconnecting the suspension means to the first end of the loop rope member; a second coupling member affixed to the target member; and a connector member having a 360 degree rotating swivel joint swivelly and releasably interconnecting the opposing second end of the rope member to the second coupling-member wherein the target member extends travels along a substantially unencumbered uniform trajectory path around as a user kicks or hits the target member; means for varying the length of the rope in relation to the suspension means thereby varying the speed of the target member along the uniform trajectory path, the suspension means further comprises an elongated post member of a predetermined height having a lowermost section, the post member extending vertically upward therefrom to a top end; a securing means for securing the lower most section of the elongated post member in an upright position; and a first cap member securely mounted onto the top end of the post member; the first coupling member being attached to the first cap member at a strategic location and the securing mechanism further comprises a base member being dimensioned to encompass the lowermost section of the post member and having a hollow cylindrical pipe member defined by a long an opened top end and an opened bottom end; the lower most section of the post member being removably inserted into the top end of the base member such that the post member freely rotates within the base member; a second cap member securely affixed to the opened bottom for preventing debris from entering the base member; the base member being firmly secured below ground level; and at least one sealing member encircling the lower most section of the post member filling a gap between the post member and the base member.

2. The martial arts training device of claim 1 wherein the securing means further comprises: a circular tubular member having a central opening defining a base area, an inner most portion of the-tubular member being cut away to form an interior cavity within the tubular member; a flat platform member being mounted to an underside of the tubular member; an adhesive material for filling the base area and the interior cavity of the tubular member such that the lower most section of the post member can be secured in an upright position within the base area.

3. The martial arts training device of claim 1 wherein the target member is a spherical shape object.

4. The martial arts training device of claim 1 wherein the connector member is permanently affixed to the target member.

5. The martial arts training device of claim 1 wherein the connector member further comprises: the swivel joint being further defined by a first side and a second side; the first side being swivelly connected to a first coupler and the second side being swivelly connected to a second coupler; and the second coupler being releasably connected to the opposing second end of the loop rope member and the first coupler being releasably connected to the second coupling member of the target member.

6. The martial arts training device of claim 1 wherein the rope further comprises a plurality of braided strands securely connected at both ends forming loop.

7. The martial arts training device of claim 1 further comprising a top cap member for securing the opened top of the base member from preventing debris from entering the base member when the post member is removed for the base member while not in use.

8. The martial arts training device of claim 1 wherein the first cap member has a conical shape with the first coupling member being attached to its apex point.

9. The martial arts training device of claim 1 further comprising a protective covering adapted to encompass the swivel connector member without inhibiting the full range of rotation of the swivel joint.

10. The martial arts training device of claim 1 further comprising: a bore extending horizontally through the base member and into the post member; a lock pin adapted to be inserted through the bore such that the post member is preventing from rotating within the base member.

11. The martial arts training device of claim 1 further comprising: the target member having an internal cavity; and an injecting port for injecting into the internal cavity weighted filling material, the injecting port being mounted into the target member and in communication with the internal cavity.

12. The martial arts training device of claim 1 where in the post member has a telescoping mechanism for adjusting the height of the post member.

13. A martial arts training device comprising: a ring shaped tubular member with an internal circumference defining a base area, the internal circumference of tubular member being cut away to form an interior cavity; a flat platform member being mounted to an underside of the tubular member, an elongated post member of a predetermined height having a lowermost section securely affixed in an upright position within the base area, the post member extending vertically upward therefrom into a top end; a conical shape cap member securely mounted onto the top end of the post member, the conical cap member having an apex point; a first coupling member being attached to the apex point of the cap member; a weighted adhesive material for filling the base area and the interior cavity of the tubular member such that the post member can be secured in an upright position within the base area; a loop rope member being defined by a first end and an opposing second end; the first end of the loop rope member being releasably connected to the first coupling member; a target member having an affixed second coupling member; a connector member having a 360 degree rotating swivel joint swivelly and releasably interconnecting the opposing second end of the rope member to the second coupler wherein the target member extends outward from the post member and travels along a substantially unencumbered uniform trajectory path around the post member as a user kicks or hits the target member.

14. The martial arts training device of claim 7 wherein the cap member further comprises: an elongated post member of a predetermined height having a lowermost section, the post member extending vertically upward therefrom to a top end; a securing means for securing the lower most section of the elongated post member in an upright position; a first bore horizontally extending through near the top end of the post member, the first bore adapted to receive a first cylindrical bolt member; a second bore vertically extending from the top end into the first bore in a perpendicular relation; a second cylindrical bolt member having a top end and a bottom end; a first coupling member attached to the top end of the second bolt member; a second fastening mechanism attached to the bottom end, the second bolt member adapted to be inserted through the second bore extending vertically downward with the fastener mechanism adapted to securely engage with the first bolt member a loop rope member being defined by a first end and an opposing second end; the first end of the loop rope member being releasably connected to the first coupling member; a target member having an affixed second coupling member; a connector member having a 360 degree rotating swivel joint swivelly and releasably interconnecting the opposing second end of the rope member to the second coupler wherein the target member extends outward from the post member and travels along a substantially unencumbered uniform trajectory path around the post member as a user kicks or hits the target member.

15. A martial arts training device comprising: an elongated post member of a predetermined height having a lowermost section, the post member extending vertically upward therefrom to a top end; a first cap member securely mounted onto the top end of the post member; a first coupling member being attached to the first cap member at a strategic location; a base member being dimensioned to encompass the lowermost section of the post member and having a hollow cylindrical pipe member defined by a long an opened top end and an opened bottom end; the lower most section of the post member being removably inserted into the top end of the base member such that the post member freely rotates within the base member; a cap member securely affixed to the opened bottom for preventing debris from entering the base member; the base member being firmly secured below round level; and at least one sealing member encircling the lower most section of the post member filling a gap between the post member and the base member a loop rope member being defined by a first end and an opposing second end; the first end of the loop rope member being releasably connected to the first coupling member; a target member baiting an affixed second coupling member; a connector member having a 360 degree rotating swivel joint swivelly and releasably interconnecting the opposing second end of the rope member to the second coupler wherein the target member extends outward from the post member and travels along a substantially unencumbered uniform trajectory path around the post member as a user kicks or hits the target member.

16. The martial arts training device of claim 2 wherein the adhesive material further comprises a filling material capable of adding weight and stability.

* * * * *